United States Patent [19]

Sansoucy

[11] Patent Number: 4,864,960

[45] Date of Patent: Sep. 12, 1989

[54] KNOCK DOWN SEMI-RIGID INFLATABLE CANOE

[76] Inventor: Roger Sansoucy, 4180 Courtrai Street, Montreal, Canada, H3S 1C3

[21] Appl. No.: 126,781

[22] Filed: Nov. 30, 1987

[51] Int. Cl.[4] ..... B63B 7/08

[52] U.S. Cl. ..... 114/345; 114/347

[58] Field of Search ..... 114/345, 347, 354

[56] References Cited

U.S. PATENT DOCUMENTS

| | | | |
|---|---|---|---|
| 1,631,047 | 5/1927 | Meyer | 114/345 |
| 2,926,363 | 3/1960 | Madlem | 114/347 |
| 4,057,865 | 11/1977 | Trautwein | 114/345 X |

*Primary Examiner*—Sherman D. Basinger

[57] ABSTRACT

This invention is related to a knock down semi-rigid, inflatable canoe in general and to a knock down canoe that folds transversally in the middle. Many knock down boats have been proposed and although most of them perform their primary objective of being easy to store, they are usually not practical to carry and sometimes safety problems occur when they capsize. Completely inflatable canoes with an inflatable bottom have been proposed. This bottom tends to be at the mercy of striking obstructions that can damage it, causing deflation. Also the inflatable feature of the bottom limits the number of shapes it can take. Inflatable boats with V or U shapes at the two ends and with flat bottom have been proposed, they are at the mercy of side winds and are less maneuverable. They do not have a hull with a Canadian or canoe like shape.

1 Claim, 1 Drawing Sheet

KNOCK DOWN SEMI-RIGID INFLATABLE CANOE

FIELD OF THE INVENTION

This invention is related to a knock down semi-rigid, inflatable canoe in general and to a knock down canoe that folds transversally in the middle.

Many knock down boats have been proposed and although most of them perform their primary objective of being easy to store, they are usually not practical to carry and sometimes safety problems occur when they capsize.

Completely inflatable canoes, with an inflatable bottom have been proposed. This bottom tends to be at the mercy of stroking obstructions that can damage it, causing deflation. Also the inflatable feature of the bottom limits the number of shapes it can take.

Inflatable boats with V or U shapes at the two ends and with flat bottoms have been proposed. They are at the mercy of side winds and are less maneuverable. They do not have a hull with a canadian or canoe like shape.

OBJECTS OF THE INVENTION

An object of the invention is to provide a knock down, semi-rigid, inflatable canoe that overcomes the above mentioned disadvantages.

Another object of the invention is to provide a knock down, semi-rigid, inflatable canoe easy and inexpensive to manufacture.

A further object is to provide means for affording rigidity to the boat when set-up for use.

SUMMARY OF THE INVENTION

There is disclosed a collapsible canoe comprising: rigid outer end sections, each end section defining an outwardly-tapering floor forming a narrow outer end and a straight inner transverse edge, and side walls upstanding from said floor and joining at and merging with said narrow outer end to form an upstanding narrow outer end part, each of said walls progressively decreasing in height, starting from said outer end part and substantially merging with said transverse inner edge, each side wall having a free top edge, an intermediate flexible water-proof quadrangular membrane having two opposite lateral edges and two transverse edges, the latter respectively fixed to said transverse edges of said end sections in a water-proof manner, an inflatable endless tube forming the top contour of said canoe and extending along and fixed in water-proof manner to the top edges of said two end sections and to the lateral edges of said membrane, said tube having outer portions flexed around said narrow outer end parts, and elongated, rigid stiffener members adapted to extend, when in operative position, longitudinally over said membrane and to engage said end sections at their inner transverse edge, whereby, when said tube is inflated with said floor and membrane resting on a flat surface and with said stiffener members in operative position, the portions of said tube attached to said membranes are close to said surface, and the portions of said tube attached to the top edge of said side walls are upwardly, outwardly inclined with said tube flexed outer portions being uppermost.

The above mentioned and other advantages of the invention will better be understood in reference to the following description and drawings in which FIG. 1 is a side view of the canoe in its set-up position.

DETAILED DESCRIPTION OF THE PREFERRED EMBODIMENT

Figure 2:
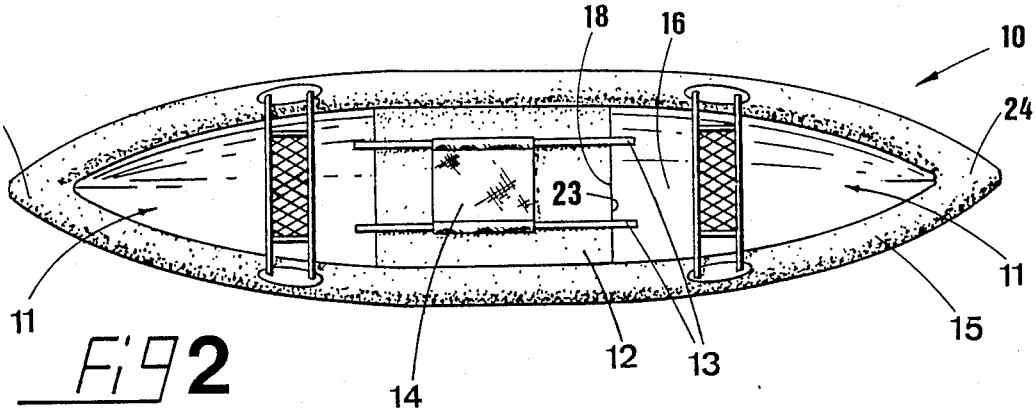
FIG. 2 is a top view of FIG. 1.
Figure 1:
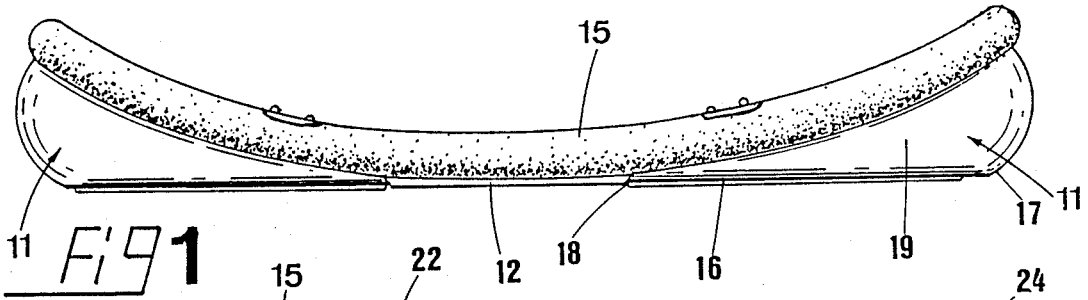
Figure 3:
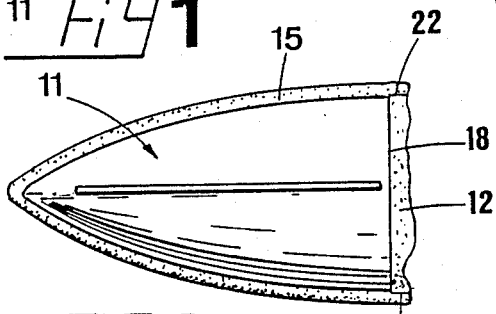
FIG. 3 is a top view of the front or rear part of the hull of the canoe.
Figure 3A:
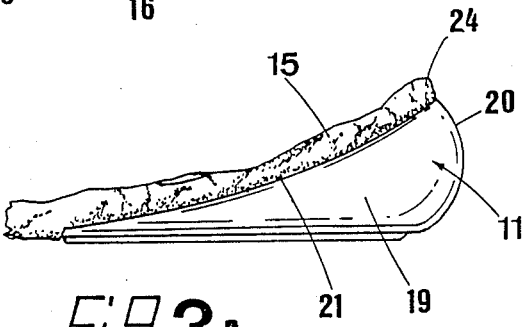
FIG. 3A is a side view of FIG. 3.
Figure 4:
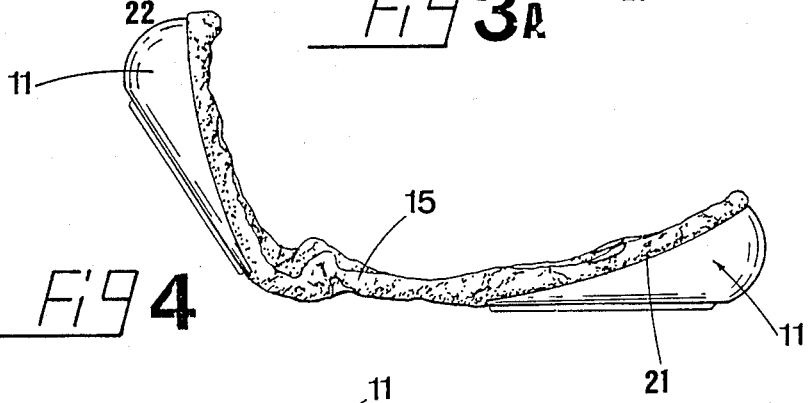
FIG. 4 is a side view of the canoe being folded.
Figure 4A:
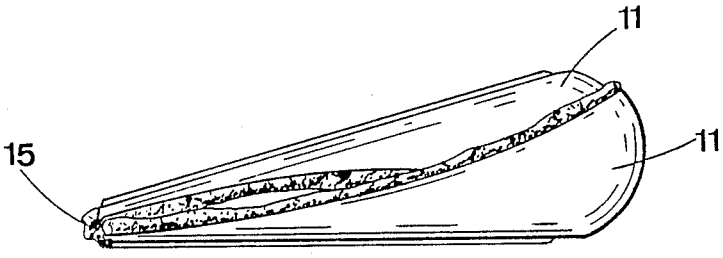
FIG. 4A is a view of the knocked down canoe.

The collapsible or knock-down canoe 10 comprises a pair of rigid outer end sections 11, each end section 11 defining an outwardly-tapering floor 16 forming a narrow outer end 17 and a straight inner transverse edge 18, and side walls 19 upstanding from said floor 16 and joining at and merging with the narrow outer end 17 to form an upstanding narrow outer end part 20. Each of the walls 19 progressively decreases in height, starting from the outer end part 20, and substantially merges with the transverse inner edge 18. Each side wall 19 has a free top edge 21. Canoe 10 further includes an intermediate flexible water-proof quadrangular membrane 12, having two opposite lateral edges 22 and two transverse edges 23, the latter respectively fixed to the transverse edge 18 of the two end sections 11 in a water-proof manner. An inflatable endless tube 15 forms the top contour of the canoe 10 and extends along and is fixed in water-proof manner to the top edges 21 of the two outer end sections 11 and to the top edges 21 of the two outer end sections 11 and to the lateral edges 22 of the membrane 12. The tube 15 has outer portions 24, which are flexed around and are secured to each narrow outer end part 20. Elongated, rigid stiffener members, or bars 13, are adapted to extend, when in operative position, longitudinally over the membrane 12 and to engage the end sections 11 at the floor inner transverse edge 18. A plate 14 is fixed to membrane 12. When tube 15 is inflated with the floors 16 and the membrane 12 resting on a flat surface and with the stiffener members 13 in operative position, the portions of the tube 13 attached to membrane 12 ae close to said surface and the portions of the tube 15 attached to the top edge 21 of side walls 19, are upwardly, outwardly inclined with the tube flexed outer portions 24 being uppermost.

I claim:

1. A collapsible canoe comprising rigid outer end sections, each end section defining an outwardly-tapering floor forming a narrow outer end and a straight inner transverse edge, and side walls upstanding from said floor and joining at and merging with said narrow outer end to form an upstanding narrow outer end part, each of said walls progressively decreasing in height, starting from said outer end part and substantially merging with said transverse inner edge, each side wall having a free top edge, and intermediate flexible water-proof quadrangular membrane having two opposite lateral edges and two transverse edges, the latter respectively fixed to said transverse edges of said end sections in a water-proof manner, an inflatable endless tube forming the top contour of said canoe and extending along and fixed in water-proof manner to the top edges of said two end sections and to the lateral edges of said membrane, said tube having outer portions flexed around said narrow outer end parts, and elongated, rigid stiffener members adapted to extend, when in operative position, longitudinally over said membrane and to engage said end sections at their inner transverse edge, whereby, when said tube is inflated with said floor and membrane resting on a flat surface and with said stiffener members in operative position, the portions of said tube attached to said membrane are close to said surface, and the portions of said tube attached to the top edge of said side walls are upwardly, outwardly inclined with said tube flexed outer portions being uppermost.

* * * * *